United States Patent [19]

Agronin et al.

[11] Patent Number: 4,480,537

[45] Date of Patent: Nov. 6, 1984

[54] METHOD AND APPARATUS FOR CALENDERING A WEB

[76] Inventors: Ronald D. Agronin; Paul J. Klemmer, both of Appleton, Wis.

[21] Appl. No.: 516,974

[22] Filed: Jul. 25, 1983

[51] Int. Cl.[3] ..... B30B 3/04; B30B 13/00

[52] U.S. Cl. ..... 100/38; 100/47; 100/162 B; 29/116 AD; 72/243

[58] Field of Search ..... 100/35, 38, 43, 47, 100/93 RP; 72/241, 242, 243, 245; 29/116 AD, 113 AD

[56] References Cited

U.S. PATENT DOCUMENTS

| | | | |
|---|---|---|---|
| 4,074,624 | 2/1978 | Biornstad et al. | 29/116 AD |
| 4,114,528 | 9/1978 | Walker | 100/162 B X |
| 4,327,468 | 5/1982 | Kusters . | |
| 4,370,923 | 2/1983 | Schmidt | 100/93 RP |
| 4,432,277 | 2/1984 | Hartmann | 100/38 |

OTHER PUBLICATIONS

H. J. Schultz: "The Nipco Roll for Cross Machine Profile Adjustment in Supercalenders".

Farrel Machinery Group; Bulletin No. 134, pp. 1 and 2, (Type XL), Apr. 1980.

Eduard Kusters; Information Bulletin No. 1, Oct. 1982.

*Primary Examiner*—Peter Feldman

*Attorney, Agent, or Firm*—McDougall, Hersh & Scott

[57] ABSTRACT

The invention comprises a method and apparatus for accurately calendering a web of material, such as paper. Zone control rolls of variable geometric profile are provided for a super calender at the top and bottom nips. The upper zone control roll has its geometric profile along the nip altered as a function of web caliper. The bottom zone control roll has its geometric profile altered as a function of temperature measured at the bottom compliant roll of the super calender.

16 Claims, 10 Drawing Figures

PRIOR ART DEVICE

ADUSTABLE CROWN

METHOD AND APPARATUS FOR CALENDERING A WEB

BACKGROUND OF THE INVENTION

This invention relates to the field of calendering machines and in particular to super calenders of the type used to finish paper webs for printing or other applications where a relatively high smoothness is required. In super calenders the paper web passes between the nips of a number of rollers pairs which, by application of circumferential friction, effect a polishing action on the web.

The rolls are generally arranged in a vertical stack with iron rolls alternating with paper filled or similarly compliant rolls.

The function of the super calender is two-fold. First, it is desired to uniformly size the web, that is, to set its caliper. Second, it is desired to polish the web while maintaining caliper and bulk.

Super calenders are fairly large machines having up to twenty rolls. The applied pressure plus the weight of the stack of rolls, therefore, is quite significant, causing deformation in the geometric profile of the rolls in the stack. Such deformities cause undesirable variations in the web in both bulk and caliper, as well as affecting polishing action.

To deal with this deformation rolls are often crowned so that they are slightly larger in the center than the ends or quarterpoints, as they are known in the art. This technique alone is insufficient to deal with rolling variation and uneven wear as the web passes through the super calender with the result that hot spots occur and web quality and dimension are adversely affected. A hot spot will occur at varying points along the nip of each pair of rolls. A hot spot results from excessive nip pressure causing a temperature increase. This excessive heat causes thermal crowning, a condition that breeds on itself.

In an effort to improve web handling, variable crown rolls have been developed and are often referred to as zone control rolls. Such rolls permit selective deformation of the surface of the roll (the shell) to control its geometric profile across the area of the nip. See, for example, U.S. Pat. No. 4,327,468.

Zone control rolls usually employ internal hydraulic elements which are actuable, in groups or individually, to produce a variable geometry crown. As detailed in the prior art statement, it is known to employ a zone control roll for the top nip of a calender stack and to control its geometric profile as a function of web caliper. In particular, this was accomplished by applicants' assignee in an actual installation in the United States in 1979. This installation, while providing improved (more uniform) web caliper, did not entirely solve the problem.

In general, the caliper of a web is determined by the pressure applied as the web passes through the first few nips of a super calender. By employing a zone control roll at the top of the stack, caliper can be accurately set. Hot spots, however, occurring due to irregularities in the remaining nips of the stack, continue to occur and affect polish and bulk.

In an attempt to improve this situation, it was proposed to employ zone control rolls at the top and bottom of the super calender stack and to control the geometric profiles thereof, in tandem, as a function of caliper. See Reference No. 2 in the accompanying Prior Art Statement.

This tandem or floating system employs a pair of zone control rolls with a self-loading system in which the deformable shells float *without* bearing support. In this scheme the top and bottom zone control rolls are interdependent and operated by a single set of controls as a function of measured caliper of the web emerging from the calender. It is believed that the results of this system are not satisfactory due to the interdependence of the two zone control rolls. Adjustment of one affects the adjustment of the other and both are controlled only as a function of measured caliper.

The present applicants have determined that a web of superior quality can be produced by providing bearing supported top and bottom zone control rolls which are *independently* controlled, and wherein the top zone control roll has its geometric profile altered as a function of measured caliper of the web while the bottom zone control roll has its geometric profile altered as a function of the temperature of the bottom compliant (filled) roll. This arrangement, not known in the art, overcomes the two major problems in super calendering: (1) caliper is accurately controlled by the top zone control roll; (2) hot spots encountered in the super calender are effectively compensated for in the final nip by detecting the hot spots and modifying the geometry of the bottom zone control roll to compensate therefor.

The present invention results from discovery of the nature of the problem unsolved by the prior art and from solving that problem by recognizing that the upper zone control roll must function to set caliper while the lower zone control roll must function—independently of the upper roll— to control the temperature profile across the final compliant roll of the super calender.

It is accordingly an object of the present invention to provide a method and apparatus for improved super calendering of web material.

Another object of the invention is to provide a method and apparatus for super calendering having a pair of independently functioning zone control rolls, one of which is controlled as a function of caliper, the other as a function of temperature.

A further object of the invention is to provide a method and apparatus which overcomes the deficiencies of the prior art by providing a variable geometry nip at the top of a super calender and a variable geometry nip at the bottom of a super calender and controlling said nips as functions of caliper and temperature, respectively.

Another object of the invention is to provide an improved super calendering device and method to obtain improved caliper bulk and polish characteristics of a web passing therethrough.

Other object and advantages of the invention will be apparent from the remaining portion of the specification.

DETAILED DESCRIPTION

Figure 1:
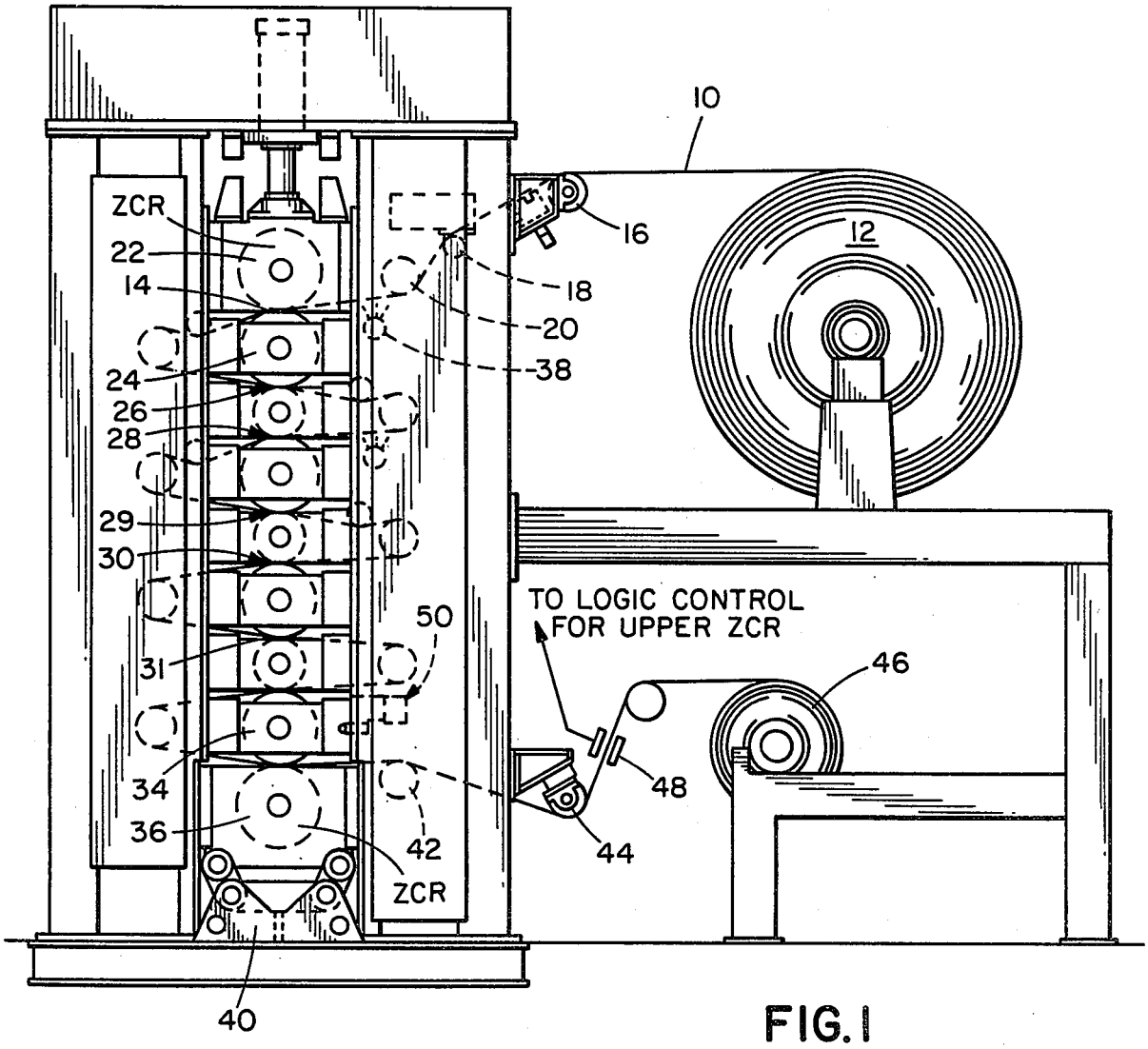
FIG. 1 is a side elevational view of a super calender designed according to the present invention.

Referring to FIG. 1, a super calender employing the invention is illustrated. The machine receives a web of material 10, such as paper, from a wind up roll 12. The web passes through a first nip 14 via various auxiliary rolls, such as 16, 18 and 20, for purposes well known to those skilled in the art. After passing through a first nip, formed by a zone control roll 22 and a compliant roll 24, the web continues travelling through the remaining nips of the calender machine as indicated at 26 through 31 and a final nip 32 formed of a compliant roll 34 and a zone control roll 36.

Before and after each nip in the super calender the web passes around auxiliary rolls, such as conventional fly or tensioning rolls 37. Electric eye sensors 38 are provided at various locations along the calender to detect any break in the web which would necessitate rapidly stopping the machine and separating the nips to prevent damage to the compliant rolls. For that purpose a quick drop feature, schematically indicated at 40 and described in detail in U.S. Pat. No. 4,266,475, may be employed, if desired.

Throughout this specification reference is made to a compliant roll. A compliant roll is usually a paper filled roll in which a metal shaft has mounted thereon many thousands of doughnut shaped paper disks. The disks are tightly compressed to form a polishing roll. Alternatively, it is possible to use various plastic compositions for the compliant roll and thus the use of this generic term is intended to encompass both possibilities.

After passing through the final nip 32 of the super calender, the web passes over auxiliary rolls 42 and 44 onto a wind up roll indicated at 46. Positioned between the calender and the wind up roll is a caliper profile scanner 48 of conventional design. Such scanners, well known in the art, are capable of measuring the caliper or thickness of a web transversely to the direction of web travel. In this manner the caliper and uniformity of the caliper can be measured during operation of the calendering machine.

Alternatively, caliper can be measured indirectly from a hardness profile device at the reel. In any case, the caliper information is obtained and used, as will be described, to control the geometric profile of the upper zone control roll 22.

Mounted to one member 49 of the support frame of the super calender is an infrared thermometer shown schematically at 50. This thermometer is mounted on an assembly which permits movement of the thermometer back and forth to scan the face of the compliant roll 34. In operation the infrared thermometer measures the temperature profile of the roll 34. Its output is supplied to the control logic of the lower zone control roll 36.

Figure 7:
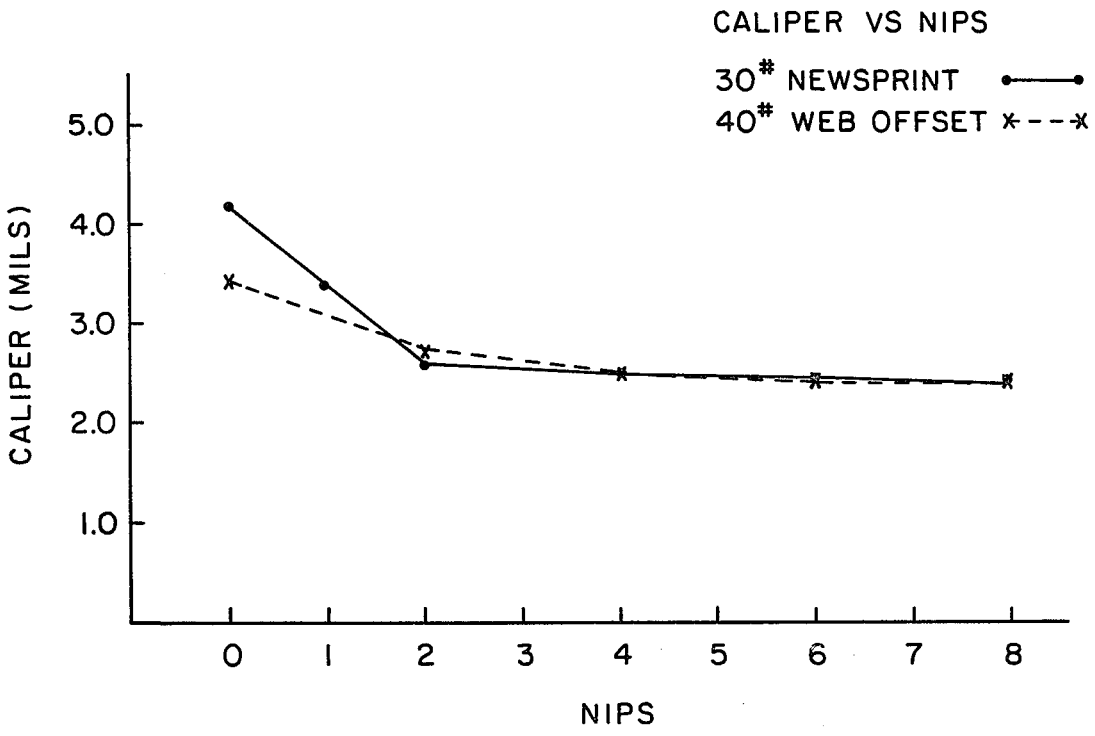
FIG. 7 is a graph useful in illustrating the relationship between caliper and the number of nips in a calender machine.

As indicated in the background portion of this specification, in order to produce high quality polished webs, it is necessary to carefully control caliper and bulk while simultaneously adjusting for "hot spots" which may occur at various nips in the super calender. The present invention employs an upper zone control roll 22 which is operated by the caliper scanner 48 to accurately set and maintain caliper of the web. As shown in FIG. 7, which is a graph of caliper versus nips, caliper is effectively determined between the first and fourth nips of the calender, subsequent nips having little or no effect on caliper. The provision of a zone control roll as part of the first nip permits significant control over caliper.

Hot spots occurring in the calender due to irregularities in the rolls, wear, damage, thermal crowning or uneven loading are a second phenomenon which must be compensated for in order to produce high quality webs. A hot spot is caused by excessive pressure at one or more points across the profile of the nips aggravated by the fact that the filled rolls themselves generate heat. Hot spots have undesirable effects on the web, such as causing excessive drying, loss of gloss and smoothness as well as possibly damaging the compliant rolls, particularly the bottom compliant roll.

We have determined that correction of these problems can be accomplished by independently controlling upper and lower zone control rolls in a super calender. The top roll is controlled as a function of measured caliper as the paper emerges from the super calender. The bottom zone control roll is controlled as a function of the temperature profile of the bottom compliant roll 34 as measured by the infrared thermometer assembly 50. This arrangement results in a superior product and is an improvement over the prior art.

Figure 2:
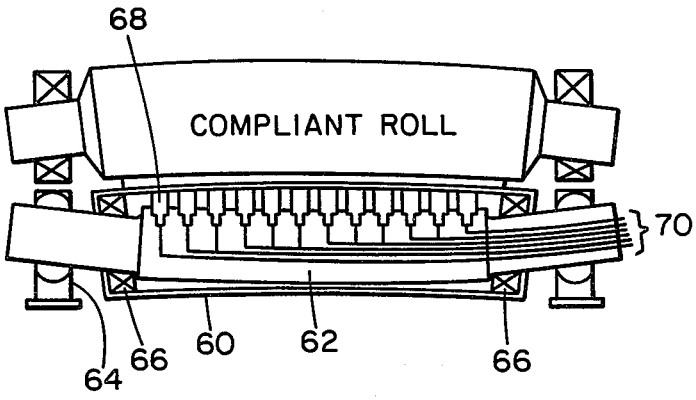
FIG. 2 is a schematic drawing of a zone control roll suitable for use in the invention.

Referring to FIG. 2, a schematic diagram of a zone control roll is illustrated. In this drawing the crown has been exaggerated to illustrate the operation. Such zone control rolls are commercially available from companies, such as Escher Wyss Ltd. of Zurich, Switzerland, and Eduard Kusters of West Germany. The embodiment shown in FIG. 2 is an Escher Wyss type but the Kusters zone control roll, known as a "vario swimming roll" is equally suitable for use in the invention. In FIG. 2 a zone control roll consists of an outer shell 60 surrounding a center shaft 62 supported at its ends as at 64. The shell, which rotates, is supported on the center shaft by bearings 66 at its ends and by a plurality of hydrostatic elements 68 along its central portion. As shown in FIG. 2, the hydrostatic elements are connected to piping 70 through which oil is supplied. By pressurizing selected ones of the hydrostatic elements 68 the shell 60 can be deformed or loaded to change its geometric profile as desired.

Figure 3:
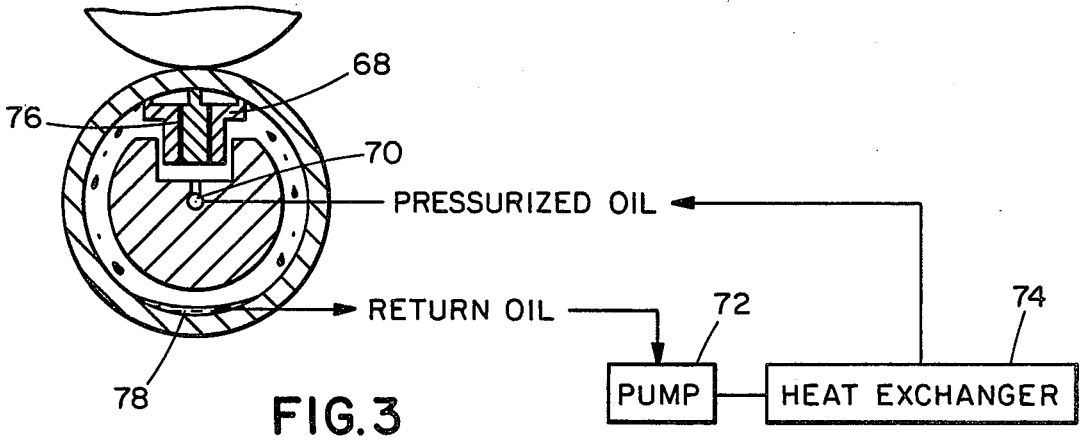
FIG. 3 is a sectional view through a zone control roll useful in understanding its operation.
Figure 3A:
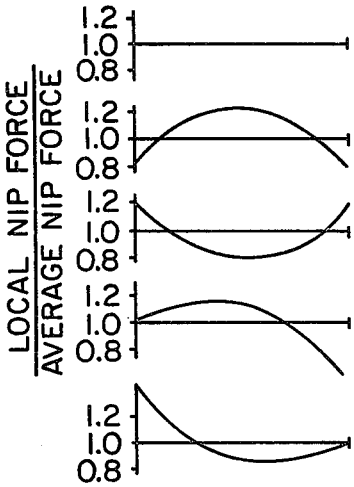
FIG. 3A is a nip force diagram illustrating operation of a zone control roll.

FIG. 3 illustrates, in greatly simplified detail, the manner in which the hydrostatic elements operate in the Escher Wyss device. The Kusters device operates on a similar principal although not in precisely the same manner. As shown in FIG. 3, a pump 72, via a heat exchanger 74, supplies pressurized oil via the piping 70 to the hydrostatic element 68. The oil passes from the bottom of the hydrostatic element, through a capillary tube 76, to the top of the element. The pressurized oil directly supports the roll shell 60. As the shell rotates a small amount of oil passes the upper seal of the element 68 and drops downwardly to a collection point at 78 where it is returned to the pump completing the cycle. By selecting which elements or groups of elements are pressurized and by controlling the pressure, various crown forces and profiles can be produced as shown in FIG. 3A.

Figure 4:
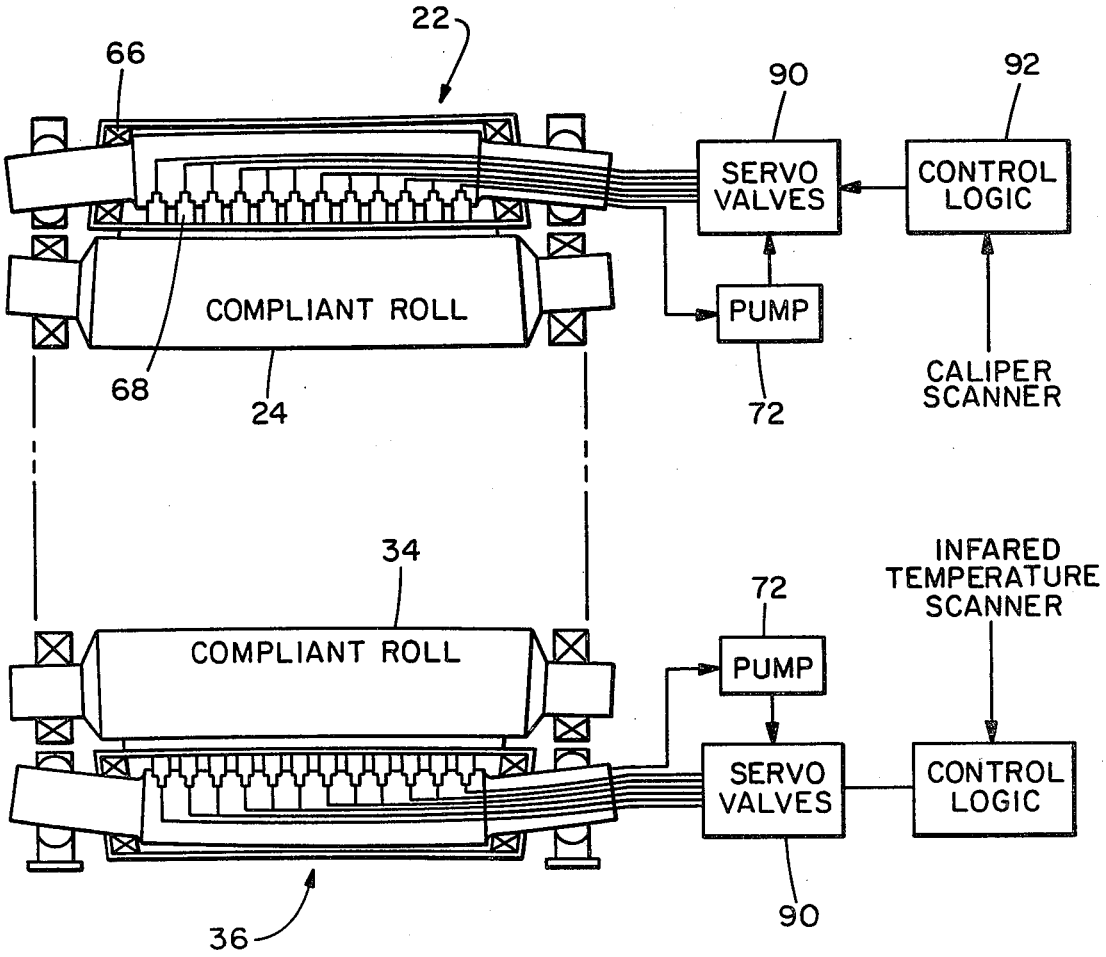
FIG. 4 is a schematic drawing of a super calender according to the invention illustrating the independent functioning of the top and bottom zone control rolls.

Referring to FIG. 4, a schematic drawing is provided showing the manner in which the upper and lower zone control rolls of the present invention are deployed. The upper zone control roll 22 has its hydrostatic element 68 controlled via the valves 90 as a function of the readout from the caliper scanner 48. The output from the scanner is provided to control logic 92, to be described and, in turn, provides the necessary signals to the valve system.

Similarly, the lower zone control roll 36 has its elements controlled as a function of the transverse temperature profile of the bottom compliant roll. This feature is an important aspect of the invention. By avoiding hot spots in the final nip of the super calender, defects in gloss and smoothness can be minimized or corrected. Thus, when the infrared temperature scanner detects a hot spot in the final nip, this is sensed and the control logic causes a change in the geometric profile of the bottom zone control roll sufficient to eliminate the hot spot.

By protecting the bottom compliant roll against hot spots two important interrelated benefits are obtained. The roll is protected against excessive heat which can damage it and the final nip is particularly effective at applying a desired gloss and smoothness to the web. In the absence of other hot spots in the calender the resulting product will be of extremely high quality. In the case of hot spots intermediate the upper and lower zone control rolls, the bottom nip will provide significant compensation therefor.

It cannot be overemphasized that the success of the present invention is dependent upon three principles: (1) Control of the upper zone control roll as a function of caliper. (2) Control of the lower zone control roll as a function of temperature of the lowest nip (indirectly measured by monitoring the temperature of the lowest compliant roll). (3) Independently controlling these zone control rolls.

In the prior art where top and bottom zone control rolls have been utilized they have employed a floating system in which the bearings 66 shown in the present invention are not utilized. In this prior art system, therefore the shells "float" and are thus interdependent. Adjustment of the upper zone control roll can and does cause a change in the loading of the lower zone control roll. This is counterproductive to accomplishing the objectives of the present invention.

Figure 5:
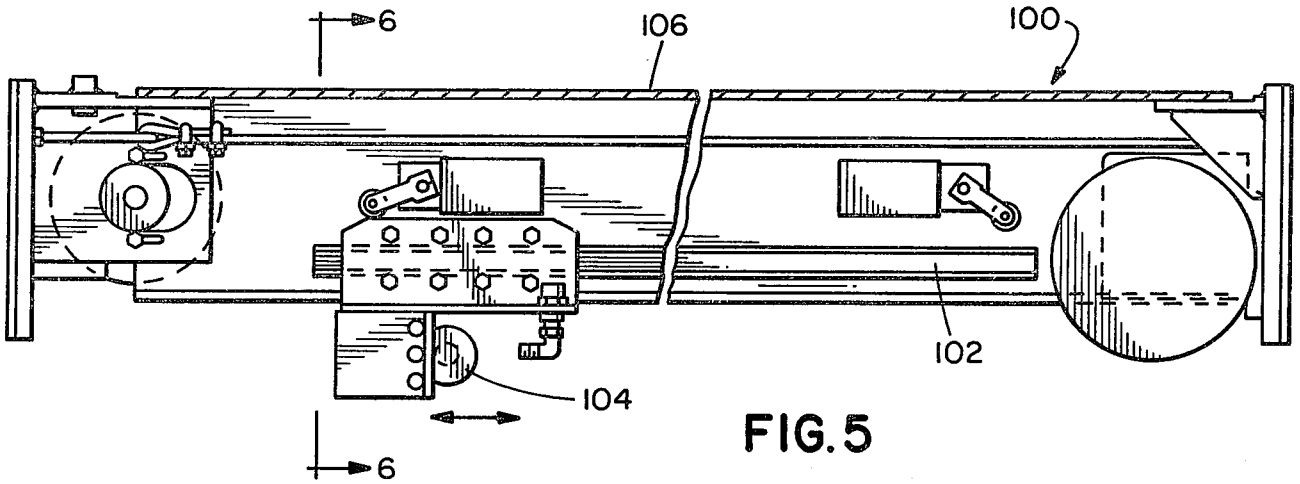
FIG. 5 is an elevational view of the mounting assembly for the infrared thermometer.
Figure 6:
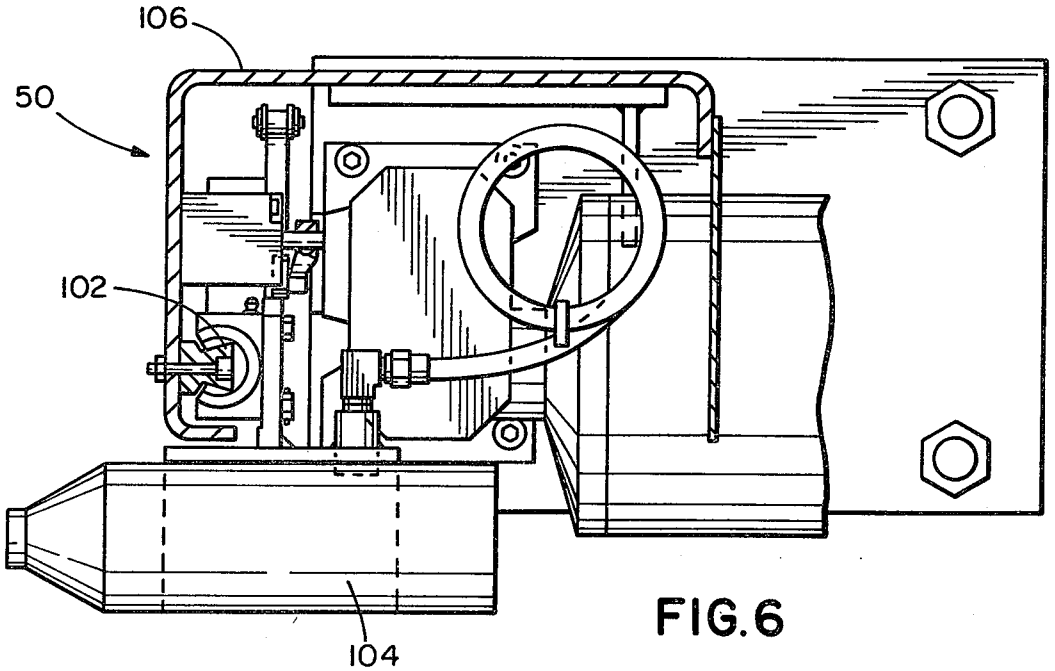
FIG. 6 is a view illustrating the manner in which the infrared thermometer is connected to the mounting assembly.

Referring to FIGS. 5 and 6, the infrared thermometer assembly is illustrated. Mounted adjacent the bottom compliant roll is an assembly 100 including a track 102 on which the infrared thermometer is mounted. A servo motor carries the thermometer back and forth on the track 102 permitting the thermometer to monitor the temperature of the bottom filled roll. FIG. 6 shows the thermometer 104 and the manner in which it is secured to the framework 106 which, in turn, is mounted to the track 102. The thermometer is conventional in design and commercially available from Capintic Instruments, Inc. as, for example, its Series 1500.

From the foregoing description it will be apparent that the zone control rolls are adjusted by the control logic in order to maintain the desired caliper of the web and temperature profiles of the bottom compliant roll. It will be apparent to those skilled in the art that many possibilities exist for implementing control logic to accomplish these purposes. In order to insure a complete disclosure, however, a preferred method will now be described.

Preferably the control logic is a digital computer as, for example, a micro computer or mini computer system of a type commercially available. In that case the control logic for the upper zone control roll will be a computer program which reads in the caliper data from the caliper sensor and adjusts one or more zones of the zone control roll responsive thereto.

Figure 8:
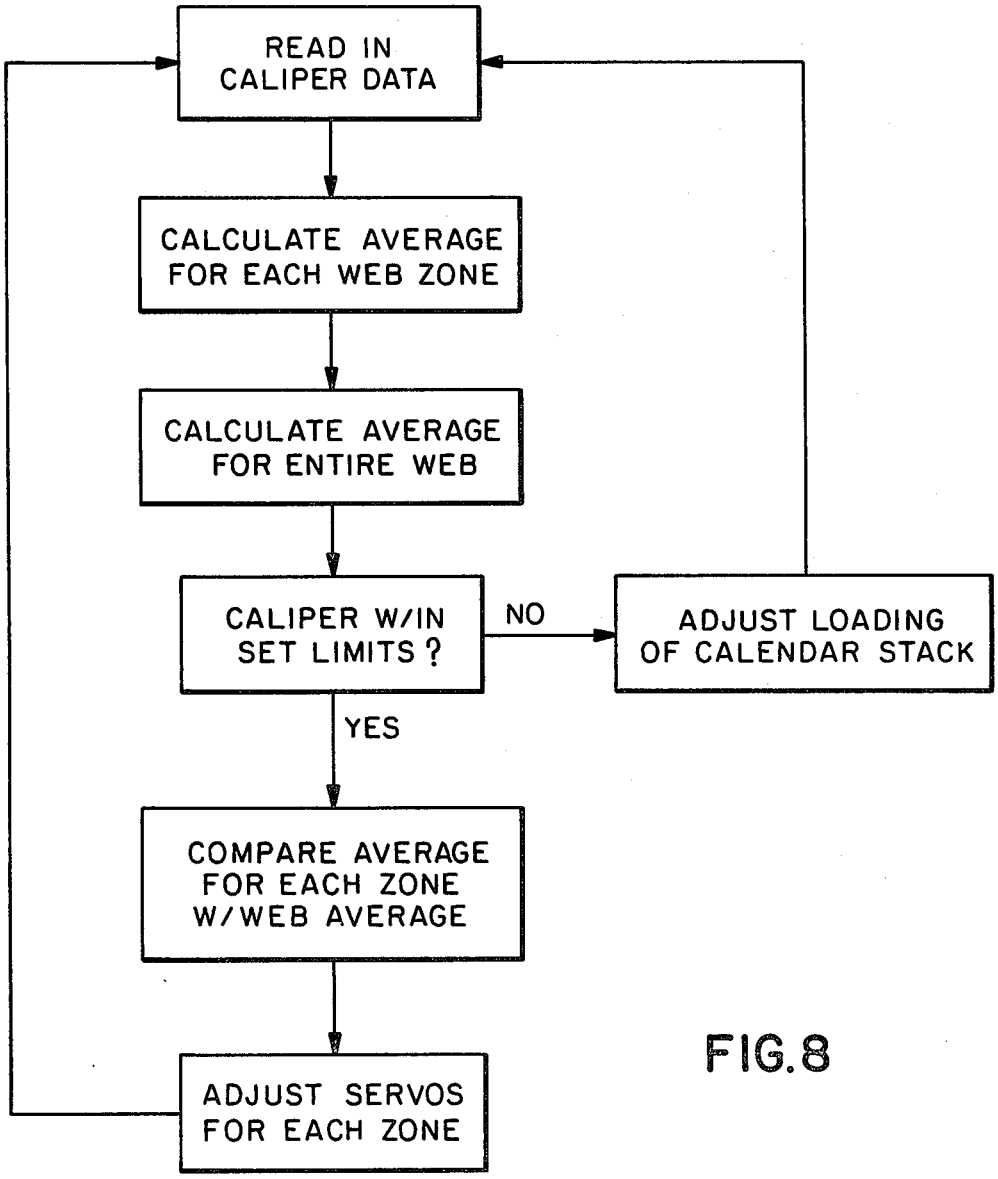
FIG. 8 is a flow diagram of a computer or logic program for controlling the upper zone control roll.

As indicated previously, the hydrostatic elements 68 can be controlled individually or preferably, according to the invention, in a number of zones across the width of the roll. For illustrative purposes it can be assumed that there are four zones comprising a left end zone, a left center zone, a right center zone and a right end zone. In that case there would be four sets of servo valves which must be controlled by the logic 92, one for each of the four zones. FIG. 8 illustrates a flow diagram of a computer program for accomplishing valve control according to the invention.

Caliper data is read in from the caliper scanner. In the usual case this data consists of an analog electrical signal representing web caliper across the web. The voltage level of the signal varies as a function of caliper. The analog signal is received by the logic system, digitized in a conventional manner and provided as input data to the computer. The computer calculates the average caliper for each of the four zones as well as an average for the entire web. The program then checkes to see if caliper is within an acceptable range. If not, an alarm condition is generated to notify the operator to adjust the loading of the calender stack.

Assuming caliper is within the desired range, the program compares the average caliper for each zone with the average caliper for the entire web and produces a control signal for the servo valves 90 causing adjustment of the pressure to each zone to eliminate deviations in a given zone which are above or below the overall average.

Figure 9:
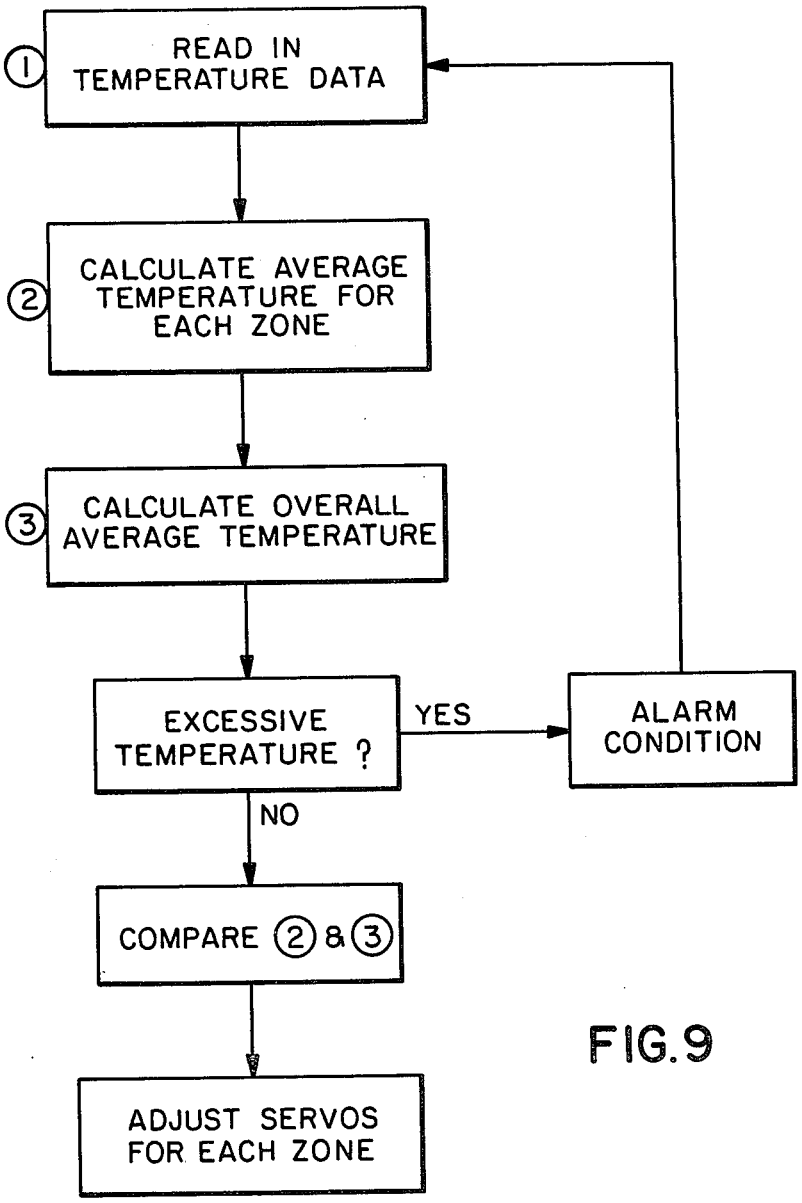
FIG. 9 is a flow diagram of a computer or logic program for controlling the lower zone control roll.

A similar technique is employed with respect to the lower zone control roll as shown in FIG. 9. The temperature data from the infrared temperature scanner is supplied to the control logic which again may be a digital computer, either the same or a different unit as desired. This data will be an analog voltage, the value of which is a function of the temperature detected along the surface of the bottom compliant roll. After digitizing, the data will be processed by the computer to calculate the average temperature for each of four zones and an overall temperature across the filled roll. If excessive temperature is detected, an alarm condition is generated notifying the operator. Otherwise the temperature in each zone is compared against the overall average temperature and the servos 93 are adjusted to eliminate hot spots.

While we have shown and described embodiments of this invention in some detail, it will be understood that this description and illustrations are offered merely by way of example, and that the invention is to be limited in scope only by the appended claims.

What is claimed is:

1. A method of calendering a web in a calender machine having a plurality of nips formed by roll pairs, to accurately control bulk, caliper and surface properties of the web comprising the steps of:

(a) providing an upper zone control roll and a compliant roll to form the first nip;
(b) providing a lower zone control roll and a compliant roll to form the final nip;
(c) controlling the geometric profile of the upper zone control roll as a function of the caliper of the web exiting the final nip;
(d) controlling the geometric profile of the lower zone control roll as a function of the temperature profile across the lower compliant roll, whereby controlling the geometric profile of the upper zone control roll permits accurate control of web caliper while control of the geometric profile of the lower zone control roll maintains control of gloss, and smoothness and protects the bottom compliant roll against excessive heat.

2. The method according to claim 1 wherein step (c) includes the substeps of:
(i) detecting the caliper of the web as it exits the final nip;
(ii) determining deviations from desired caliper;
(iii) adjusting the geometric profile of the crown of the upper zone control roll to compensate for such deviations.

3. The method according to claim 1 wherein step (d) includes the substeps of:
(i) detecting the temperature profile across the lower compliant roll;
(ii) determining deviations from a desired temperature profile;
(iii) adjusting the geometric profile of the crown of the lower zone control roll to compensate for such deviations.

4. In an apparatus for calendering a web to determine bulk, caliper and surface properties and having a plurality of nips formed by roll pairs, the improvement comprising:
(a) an upper zone control roll and a compliant roll forming the first nip;
(b) a lower zone control roll and a compliant roll forming the final nip;
(c) first means for controlling the geometric profile of the upper zone control roll as a function of the caliper of the web exiting the final nip;
(d) second means for controlling the geometric profile of the lower zone control roll as a function of the temperature profile across the bottom compliant roll, whereby controlling the geometric profile of the upper zone control roll permits accurate control of web caliper while control of the geometric profile of the lower zone control roll maintains control of gloss, smoothness and protects the bottom compliant roll against excessive heat.

5. The apparatus according to claim 4 wherein said zone control rolls are variable crown rolls having defined zones which can be independently varied in diameter to produce a desired crown profile.

6. The apparatus according to claim 5 wherein said variable crown rolls are hydraulically actuated.

7. The apparatus according to claim 4 wherein said compliant rolls are paper filled rolls.

8. The apparatus according to claim 4 wherein said first means for controlling includes:
(a) means for detecting the caliper of the web as it exits the final nip;
(b) means, responsive to the detecting means, for determining deviations of web caliper from a desired value;
(c) means for adjusting the geometric profile of the crown of the upper zone control roll to compensate for such deviations.

9. The apparatus according to claim 8 wherein the detecting means is a caliper scanner positioned along the path of the web as it exits the calendering apparatus.

10. The apparatus according to claim 8 wherein the determining means includes digital computer means receiving caliper data from the detecting means and provides control signals to the adjusting means to regulate the geometric profile of the crown.

11. The apparatus according to claim 8 wherein the adjusting means includes a hydraulic control system responsive to the determining means for controlling the hydraulic pressure to the zones of the upper zone control roll.

12. The apparatus according to claim 4 wherein said second means for controlling includes:
(a) means for detecting the temperature profile across the bottom compliant roll;
(b) means for determining deviations from a desired temperature profile;
(c) means for adjusting the geometric profile of the crown of the lower zone control roll to compensate for such deviations.

13. The apparatus according to claim 12 wherein the detecting means includes:
(a) a thermometer;
(b) means for repetitively transporting the thermometer back and forth across the surface of the bottom compliant roll.

14. The apparatus according to claim 13 wherein the thermometer is an infrared temperature scanner.

15. The apparatus according to claim 12 wherein the determining means includes digital computer means receiving temperature data from the detecting means and provides control signals to the adjusting means to regulate the geometric profile of the crown.

16. The apparatus according to claim 12 wherein the adjusting means includes a hydraulic control means system responsive to the determining means for controlling the hydraulic pressure to the lower zones of the zone control roll.

* * * * *